US008944763B2

(12) United States Patent
Lee

(10) Patent No.: US 8,944,763 B2
(45) Date of Patent: Feb. 3, 2015

(54) TURBINE BLADE COOLING SYSTEM WITH BIFURCATED MID-CHORD COOLING CHAMBER

(75) Inventor: Ching-Pang Lee, Cincinnati, OH (US)

(73) Assignee: Siemens Aktiengesellschaft, München (DE)

( * ) Notice: Subject to any disclaimer, the term of this patent is extended or adjusted under 35 U.S.C. 154(b) by 778 days.

(21) Appl. No.: 13/212,282

(22) Filed: Aug. 18, 2011

(65) Prior Publication Data

US 2013/0045111 A1 Feb. 21, 2013

(51) Int. Cl.
*F01D 5/18* (2006.01)
*F01D 5/08* (2006.01)

(52) U.S. Cl.
CPC ..... *F01D 5/087* (2013.01); *F01D 5/187* (2013.01); *F05D 2250/185* (2013.01); *F05D 2260/202* (2013.01); *F05D 2260/2212* (2013.01)
USPC ..... 416/97 R

(58) Field of Classification Search
USPC ..... 415/115; 416/90 R, 92, 96 R, 96 A, 97 R
See application file for complete search history.

(56) References Cited

U.S. PATENT DOCUMENTS

| | | | | |
|---|---|---|---|---|
| 5,165,852 | A | 11/1992 | Lee et al. | |
| 5,356,265 | A | 10/1994 | Kercher | |
| 5,538,394 | A | 7/1996 | Inomata et al. | |
| 5,700,131 | A | 12/1997 | Hall et al. | |
| 5,813,835 | A | 9/1998 | Corsmeier et al. | |
| 7,413,407 | B2 | 8/2008 | Liang | |
| 7,690,894 | B1 | 4/2010 | Liang | |
| 8,585,365 | B1 * | 11/2013 | Liang | 416/97 R |
| 2006/0222495 | A1 * | 10/2006 | Liang | 416/97 R |

* cited by examiner

*Primary Examiner* — Christopher Verdier

(57) ABSTRACT

A cooling system for a turbine blade of a turbine engine having a bifurcated mid-chord cooling chamber for reducing the temperature of the blade. The bifurcated mid-chord cooling chamber may be formed from a pressure side serpentine cooling channel and a suction side serpentine cooling channel with cooling fluids passing through the pressure side serpentine cooling channel in a direction from the trailing edge toward the leading edge and in an opposite direction through the suction side serpentine cooling channel. The pressure side and suction side serpentine cooling channels may flow counter to each other, thereby yielding a more uniform temperature distribution than conventional serpentine cooling channels.

19 Claims, 3 Drawing Sheets

TURBINE BLADE COOLING SYSTEM WITH BIFURCATED MID-CHORD COOLING CHAMBER

FIELD OF THE INVENTION

This invention is directed generally to turbine blades, and more particularly to cooling systems in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. The cooling channels are often designed to account for the external pressure profile of the airfoil. However, centrifugal forces and air flow at boundary layers often prevent some areas of the turbine blade from being adequately cooled, which results in the formation of localized hot spots. In addition, the hot gases increase the temperature of the blade, causing the development of thermal stresses through the blade. Thus, a need exists for an efficient turbine blade cooling system.

SUMMARY OF THE INVENTION

This invention relates to a turbine blade having an internal turbine blade cooling system formed from at least one cooling fluid cavity extending into an elongated blade. The cooling system may include at least one leading edge cooling channel and a bifurcated mid-chord cooling chamber extending between the leading edge and trailing edge. The bifurcated mid-chord cooling chamber may be formed from a pressure side serpentine cooling channel positioned proximate to a pressure side of the turbine blade and a suction side serpentine cooling channel positioned proximate to a suction side of the turbine blade such that cooling fluids flow through the pressure side serpentine cooling channel in a direction from a trailing edge toward a leading edge and in an opposite direction through the suction side serpentine cooling channel. The pressure side and suction side serpentine cooling channels may flow counter to each other, thereby yielding a more uniform temperature distribution than conventional serpentine cooling channels.

The turbine blade may be formed from a generally elongated blade having a leading edge, a trailing edge, a tip section at a first end, a root coupled to the blade at an end generally opposite the first end for supporting the blade and for coupling the blade to a disc, and at least one cavity forming a cooling system in the blade. The cooling system may include at least one leading edge cooling channel positioned in close proximity to the leading edge of the generally elongated blade and a bifurcated mid-chord cooling chamber positioned between the at least one leading edge cooling channel and the trailing edge. The bifurcated mid-chord cooling chamber may include a pressure side serpentine cooling channel in contact with a pressure sidewall of the generally elongated blade and a suction side serpentine cooling channel in contact with a suction sidewall of the generally elongated blade. An aperture in the mid-chord rib may provide a cooling fluid passageway between the pressure and suction side serpentine cooling channels. The aperture may be positioned in the mid-chord rib proximate to an end of the pressure side serpentine cooling channel and a beginning of the suction side serpentine cooling channel of the turbine blade to exhaust cooling fluids from the pressure side cooling fluids and to supply cooling fluids to the suction side serpentine cooling channel. An inlet may be positioned in a wall proximate to the root for allowing cooling fluids to enter the pressure side serpentine cooling channel, and at least one trailing exhaust orifice may be in fluid communication with the suction side serpentine cooling channel for exhausting cooling fluids from the suction side serpentine cooling channel through the trailing edge.

The pressure side and suction side serpentine cooling channels may be formed from at least two pass serpentine channels. In at least one embodiment, the pressure side serpentine cooling channel may be formed from a triple pass serpentine channel, and the suction side serpentine cooling channel may be formed from a quadruple pass serpentine cooling channel. The pressure side and suction side serpentine cooling channels may also be positioned relative to each other such that a cooling fluid flow direction through the suction side serpentine cooling channel is generally opposite to the cooling fluid flow in adjacent portions of the pressure side serpentine cooling channel, thereby forming cooling fluid counterflow between the pressure side and suction side serpentine cooling channels. A first channel of the pressure side serpentine cooling channel may include an inlet for receiving cooling fluids that is in communication with a fluid supply chamber. Second and third channels of the pressure side serpentine cooling channel may be positioned between the first channel and the leading edge of the generally elongated blade, thereby creating a cooling fluid flow in the pressure side serpentine cooling channel flowing in a direction from the trailing edge to the leading edge. The counterflow in the pressure side and suction side serpentine cooling channels creates a more uniform temperature distribution for the mid-chord region of the turbine blade than conventional serpentine cooling channels.

A leading edge supply chamber may extend spanwise and be positioned between the leading edge cooling channel and a rib defining a portion of the pressure and suction side serpentine cooling channels. One or more impingement orifices may be positioned in a rib separating the leading edge supply channel from the leading edge cooling channel. The impingement orifices may provide a cooling fluid pathway between the leading edge supply chamber and the leading edge cooling channel. One or more film cooling orifices may be positioned in an outer wall forming the leading edge. The film cooling orifice may be a plurality of film cooling holes forming a showerhead.

The leading edge supply chamber and the pressure side serpentine cooling channel may be separated by rib, thereby preventing cooling fluid movement between the leading edge supply chamber and the pressure side serpentine cooling channel. The leading edge supply chamber and the suction side serpentine cooling channel may be separated by rib, thereby preventing cooling fluid movement between the leading edge supply chamber and the suction side serpentine cooling channel.

A fourth channel of the suction side serpentine cooling channel, which is downstream from upstream first, second and third channels, may extend from the pressure sidewall to the suction sidewall. First, second and third channels may be positioned in close proximity to the channels of the pressure side serpentine cooling channels. One or more trailing edge exhaust orifices may extend from the suction side serpentine cooling channel to the trailing edge to exhaust cooling fluids through the trailing edge.

The cooling system of the turbine blade is advantageous for numerous reasons. In particular, the bifurcated mid-chord cooling chamber increases the efficiency of the turbine blade cooling system in the turbine blade. For instance, the bifurcated mid-chord cooling chamber enables the overall cooling flow requirement to be reduced by enabling the cooling system proximate to the pressure sidewall to be tailored based on heating load. The bifurcated mid-chord cooling chamber also enables high aspect ratio flow channels to be used, which improves the manufacturability, reduces the difficulty of installing film cooling holes, increases the internal hot surface area for turbulators to enhance internal cooling, and increases the internal convective area for the hot gas side area ratio. The bifurcated mid-chord cooling chamber also eliminates design issues, such as back flow margin (BFM) and high blowing ratio, that are typical for suction side film cooling holes in conventional designs. The bifurcated mid-chord cooling chamber may also utilize a single cooling flow circuit, which increases the cooling flow mass flux, thereby yielding a higher internal convective cooling performance than a conventional mid-chord serpentine cooling channel.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
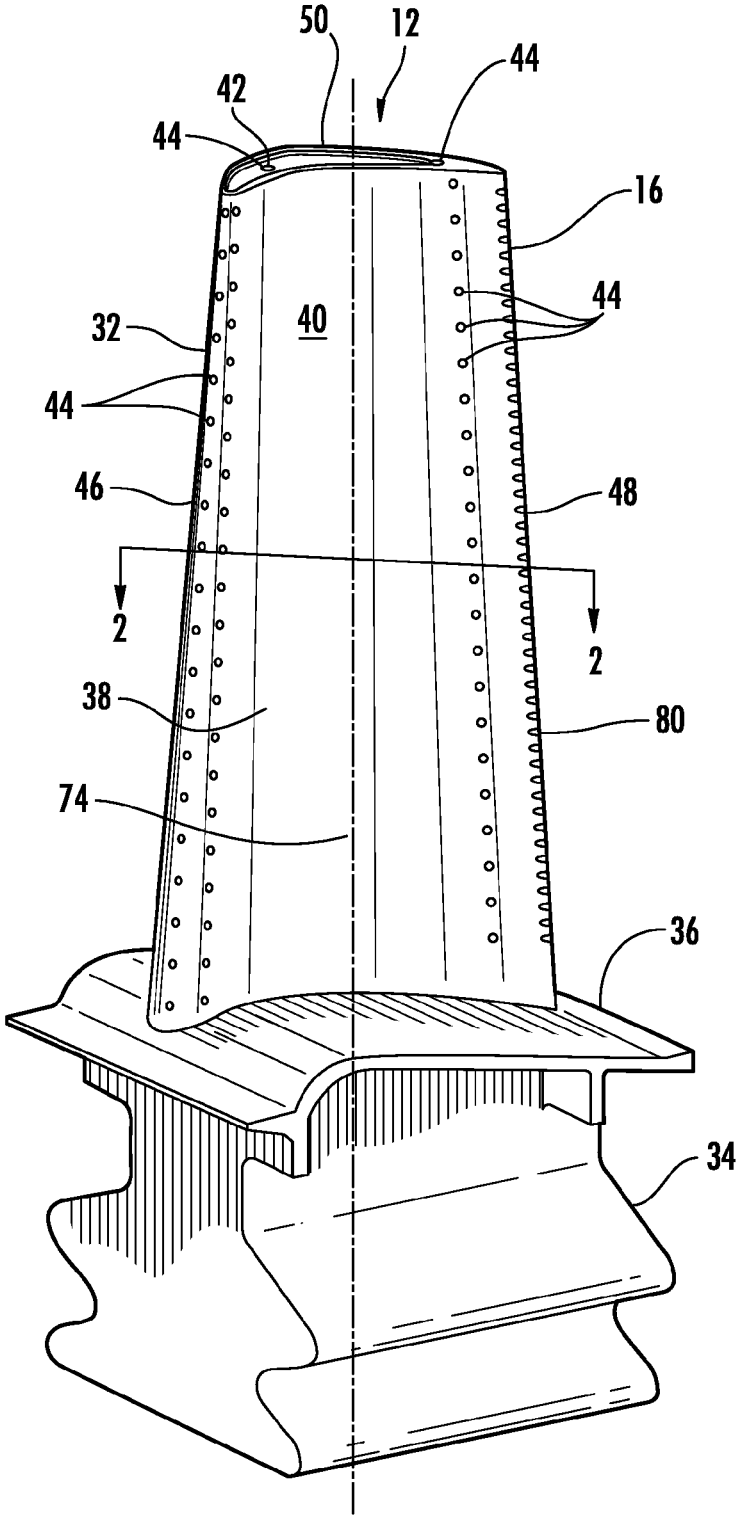
FIG. 1 is a perspective view of a turbine blade having features according to the instant invention.

As shown in FIGS. 1-4, this invention is directed to a turbine blade cooling system 10 for turbine blades 12 used in turbine engines. The turbine blade 12 may include a bifurcated mid-chord cooling chamber 22 formed from a pressure side serpentine cooling channel 24 and a suction side serpentine cooling channel 28 with cooling fluids passing through the pressure side serpentine cooling channel 28 in a direction from a trailing edge 48 toward a leading edge 46 and in an opposite direction through the suction side serpentine cooling channel 28. The pressure side and suction side serpentine cooling channels 24, 28 may flow counter to each other, thereby yielding a more uniform temperature distribution than conventional serpentine cooling channels.

Figure 2:
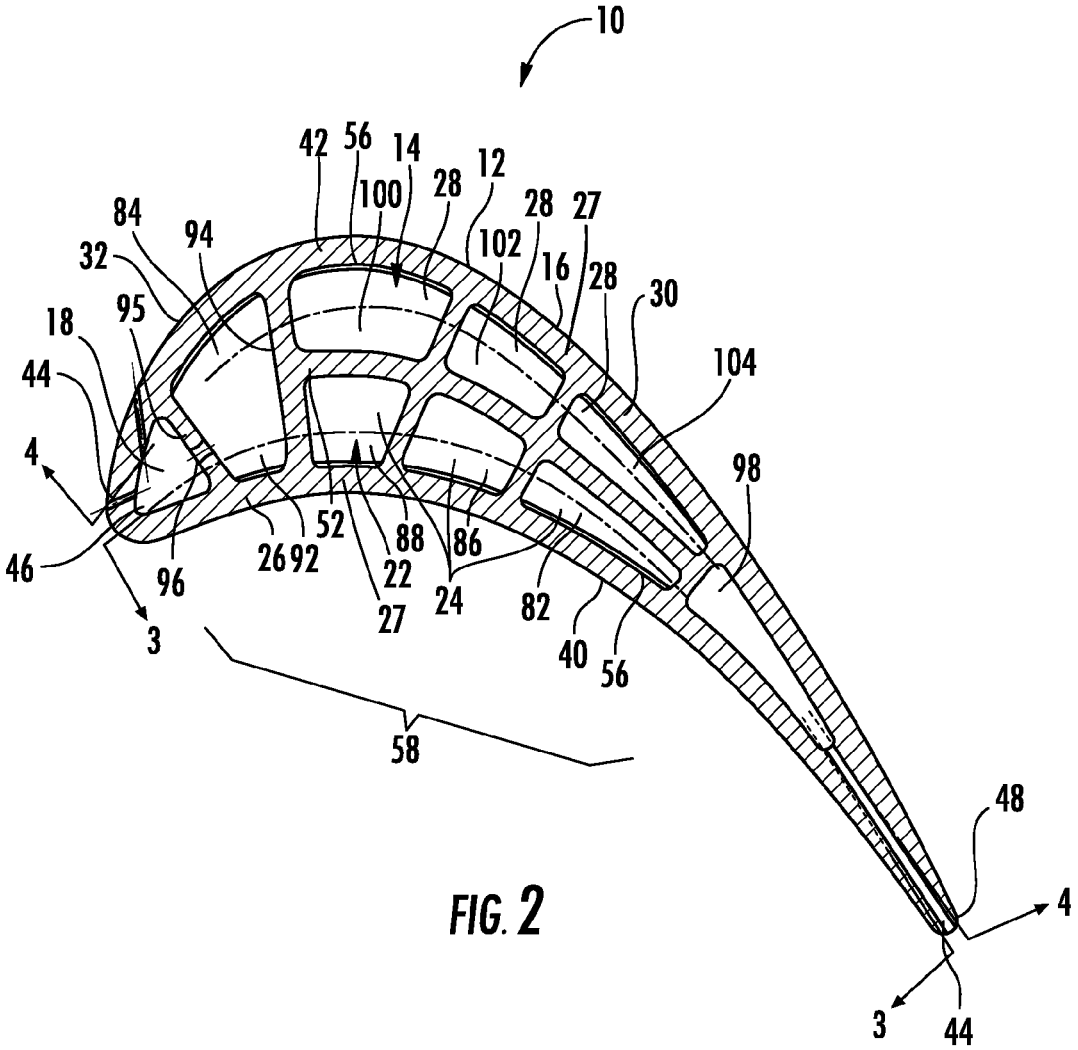
FIG. 2 is cross-sectional view of the turbine blade shown in FIG. 2 taken along section line 2-2.

The turbine blade cooling system 10 may be directed to a cooling system 10 located in a cavity 14, as shown in FIG. 2, positioned between two or more walls 27 forming a housing 16 of the turbine blade 12. The cooling system 10 may include one or more leading edge cooling channels 18 and a bifurcated mid-chord cooling chamber 22 positioned between the leading edge cooling channel 18 and the trailing edge 48. The bifurcated mid-chord cooling chamber 22 may be formed from a pressure side serpentine cooling channel 24 in contact with a pressure sidewall 26 of the turbine blade 12 and a suction side serpentine cooling channel 28 in contact with the suction sidewall 30 of the turbine blade 12. The bifurcated mid-chord cooling chamber 22 may be configured to pass cooling fluids through the pressure side serpentine cooling channel 24 and exhaust the cooling fluids into the suction side serpentine cooling channel 28 to supply the suction side serpentine cooling channel 28 with cooling fluids. The cooling fluids are passed through the suction side serpentine cooling channels 28 and exhausted from turbine blade 12 through the trailing edge 48, and in at least one embodiment, through a trailing edge exhaust orifice 80 extending from the suction side serpentine cooling channel 28 to the trailing edge 48 to exhaust cooling fluids through the trailing edge 48. The bifurcated mid-chord cooling configuration enables a longer cooling circuit to be tailored to the hot gas side pressure distribution, which yields a higher internal convection efficiency for the cooling system 10. In at least one embodiment, the cooling system 10 may form a cooling pathway having a single cooling fluid inlet 54 for admitting cooling fluids into the cooling system 10, thereby forming a single cooling flow circuit.

The cooling fluid inlet 54 may be positioned in a first channel 82 of the pressure side serpentine cooling channel 24 in communication with a cooling fluid supply channel 84. Second and third channels 86, 88 of the pressure side serpentine cooling channel 28 may be positioned between the first channel 82 and the leading edge 46 of the generally elongated blade 32, thereby creating a cooling fluid flow in the pressure side serpentine cooling channel 24 flowing in a direction from the trailing edge 48 to the leading edge 46.

Figure 4:
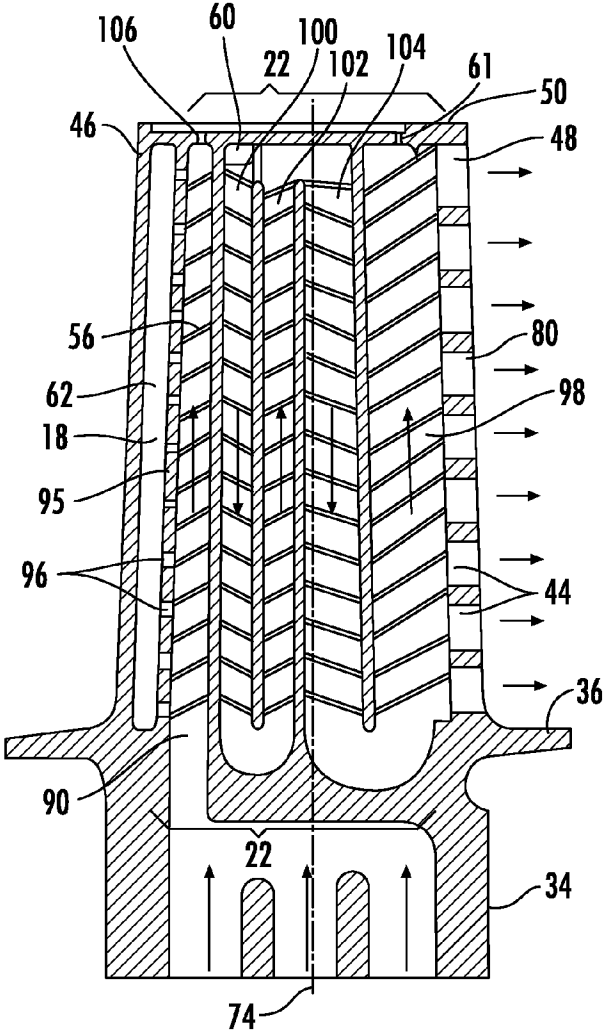
FIG. 4 is cross-sectional filleted view of the turbine blade shown in FIG. 2 taken along section line 4-4.
Figure 3:
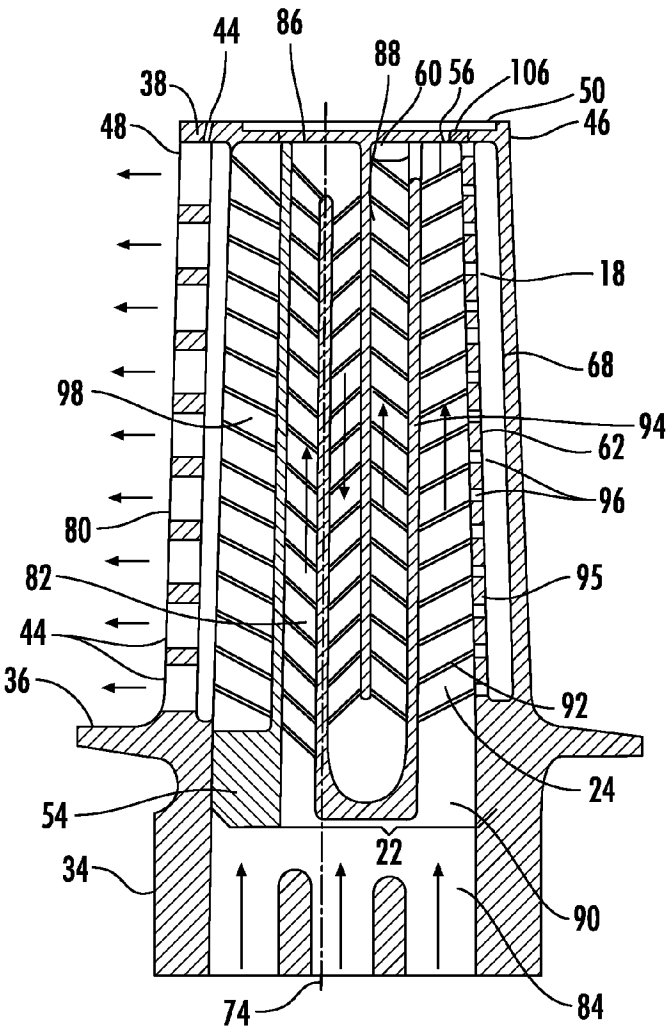
FIG. 3 is cross-sectional view, referred to as a filleted view, of the turbine blade shown in FIG. 2 taken along section line 3-3.

As shown in FIG. 1, the turbine blade 12 may be formed from the generally elongated blade 32 coupled to a root 34 at a platform 36. Blade 32 may have an outer wall 38 adapted for use, for example, in a first stage of an axial flow turbine engine. Outer wall 38 may form a generally concave shaped portion forming pressure side 40 and may form a generally convex shaped portion forming suction side 42. The cavity 14, as shown in FIGS. 2-4, may be positioned in inner aspects of the blade 32 for directing one or more gases, which may include air received from a compressor (not shown), through the blade 32 and out one or more exhaust orifices 44 in the blade 32 to reduce the temperature of the blade 32. As shown in FIG. 1, the exhaust orifices 44 may be positioned in the leading edge 46, the trailing edge 48, the tip 50 in close proximity to the leading and trailing edges 46, 48, or any combination thereof, and have various configurations. The leading edge 46 may include a plurality of orifices 44 that collective form a showerhead for cooling the leading edge 46 of the blade 32. The cavity 14 may be arranged in various configurations and is not limited to a particular flow path.

As shown in FIG. 2, the bifurcated mid-chord cooling chamber 22 may be formed from the pressure side serpentine cooling channel 24 and the suction side serpentine cooling channel 28 separated by a mid-chord rib 52. The pressure side and suction side serpentine cooling channels may be positioned generally parallel to a longitudinal axis 74 of the blade 32, shown in FIGS. 3 and 4. The pressure side serpentine channel 24 may include an inlet 54 proximate to the root 34 for receiving cooling fluids from a cooling fluid source. In at least one embodiment, the inlet 54 is the only inlet for cooling fluids to enter the pressure side serpentine cooling channel 24. The turbine blade cooling system 10 may also include an inlet 90 in an inboard end of a leading edge supply chamber 92. The leading edge supply chamber 92 may extend spanwise and may be positioned between the leading edge cooling channel 18 and a rib 94 defining the pressure and suction side serpentine cooling channels 24, 28. One or more impingement orifices 96 may be positioned in a rib 95 separating the leading edge supply chamber 92 from the leading edge cooling channel 18. The impingement orifices 96 meter the flow of cooling fluids from the leading edge supply chamber 92 into the leading edge cooling channel 18. The leading edge supply chamber 92 may include one or more tip exhaust orifices 106 extending between the leading edge supply chamber and an outer surface of the tip 50. The leading edge supply chamber 92 and the pressure side serpentine cooling channel 24 may be separated by the rib 94, thereby preventing cooling fluid movement between the leading edge cooling channel 18 and the pressure side serpentine cooling channel 24. The leading edge supply chamber 92 and the suction side serpentine cooling channel 28 may be separated by the rib 94, thereby preventing cooling fluid movement between the leading edge cooling channel 18 and the suction side serpentine cooling channel 28.

The pressure side serpentine cooling channel 24 may extend from a position proximate the root 34 to the tip 50 of the blade 32. The pressure side serpentine cooling channel 24 may be formed from at least a two pass serpentine cooling channel, and, in at least one embodiment as shown in FIGS. 2 and 3, may be a triple pass serpentine cooling channel. The pressure side serpentine cooling channel 24 may include a plurality of trip strips 56 positioned in the channel 24 for increasing the efficiency of the cooling system 10. The trip strips 56 in the pressure side serpentine cooling channel 24 may be positioned at various angles and spacing to increase the efficiency of the cooling system 10.

The suction side serpentine cooling channel 28 may extend from a position proximate to the root 34 to the tip 50 of the blade 32, in a similar fashion to the pressure side serpentine cooling channel 24. The suction side serpentine cooling channel 28 may be formed from at least a two pass serpentine cooling channel, and in at least one embodiment, as shown in FIGS. 2 and 4, may be a quadruple pass serpentine cooling channel. The suction side serpentine cooling channel 28 may include a plurality of trip strips 56 positioned in the channel 28 for increasing the efficiency of the cooling system 10. The trip strips 56 in the suction side serpentine cooling channel 28 may be positioned at various angles and spacing to increase the efficiency of the cooling system 10.

The suction side serpentine cooling channel 28 may be positioned relative to the pressure side serpentine cooling channel 24 such that a cooling fluid flow direction through the suction side serpentine cooling channel 28 is generally opposite to the cooling fluid flow in adjacent portions of the pressure side serpentine cooling channel 24, thereby forming cooling fluid counterflow between the pressure side and suction side serpentine cooling channels 24, 28. The counterflow between the pressure side and suction side serpentine cooling channels 24, 28 may form a more uniform temperature distribution than conventional cooling system configurations for the mid-chord region 58, thereby reducing thermal stresses in the blade 32. Cooling fluid flow in the pressure side serpentine cooling channel 24 may be in a direction from the trailing edge 48 to the leading edge 46, and generally in an opposite direction for the suction side serpentine cooling channel 28. The bifurcated mid-chord cooling chamber 22 has the cooling flow direction first from the trailing edge 48 to the leading edge 46 in the pressure side serpentine cooling channel 24 and then to the suction side serpentine cooling channels 28 in the opposite direction. This arrangement positions the cooling circuit ends at the trailing edge 48 where both the cooling air pressure and hot gas pressure are all smaller. This arrangement has an adequate back-flow-margin without overflowing through the trailing edge exhaust orifices 80.

The suction side serpentine cooling channel 28 may be in communication with the pressure side serpentine cooling channel 24 to receive cooling fluids. In at least one embodiment, the suction side serpentine cooling channel 28 may include an aperture 60 that provides a pathway through the mid-chord rib 52. In at least one embodiment, the aperture 60 may be positioned proximate to the tip 50 of the blade 32. The aperture 60 may be positioned at an end of the pressure side serpentine cooling channel 24 and at the beginning of the suction side serpentine cooling channel 28. The suction side serpentine cooling channel 28 may also include at least one trailing edge exhaust orifice 80 extending from the suction side serpentine cooling channel 28 to the trailing edge 48 to exhaust cooling fluids through the trailing edge 48. In at least one embodiment, the trailing edge exhaust orifices 80 may extend from a most downstream channel of the suction side serpentine cooling channel 28, which in one embodiment may be fourth channel 98, through the trailing edge 48. The fourth channel 98 of the suction side serpentine cooling channel 28, which is downstream from upstream first, second and third channels 100, 102, 104, extends from the pressure sidewall 26 to the suction sidewall 30.

In at least one embodiment, as shown in FIG. 3, the leading edge cavity 18 may be formed from one or more cooling chambers 62. The leading edge supply chamber 92 may supply cooling fluids to the leading edge cavity 18. A plurality of impingement orifices 96 may be positioned in a rib 95 separating the leading edge cooling channel 18 from the leading edge supply chamber 92. In at least one embodiment, the plurality of impingement orifices 96 may extend from the leading edge supply chamber 92 to the leading edge cooling channel 18. The rib 95 may be positioned in the blade 32 such that cooling fluids flowing through the impingement orifices 96 impinge on a backside surface 68 of the leading edge 46.

During use, cooling fluids may be passed from a cooling fluid supply (not shown), such as but not limited to, a compressor, to the root 34. Cooling fluids are then admitted into the cooling system 12 through the inlet 54 between the root 34 and the pressure side serpentine cooling channel 24. A portion of the cooling fluids enter the pressure side serpentine cooling channel 24, and a portion of the cooling fluids enter the leading edge supply chamber 92 through inlet 90. The cooling fluids pass from the leading edge supply chamber 92 through a plurality of impingement orifices 96 in the rib 95 separating the leading edge supply chamber 92 from the leading edge cooling channel 18. The cooling fluids may impinge on a backside surface of the leading edge 46 and may be exhausted through the orifices 44 forming the showerhead. A portion of the cooling fluids may be exhausted through the tip exhaust orifice 106. The cooling fluids in the pressure side serpentine cooling channel 24 flow through the pressure side serpentine cooling channel 24 absorbing heat from the surfaces of the channel 24 formed by the pressure sidewall 26 and the mid-chord rib 52. The cooling fluids pass through the pressure side serpentine cooling channel 24 generally along the longitudinal axis 74 and move in a direction generally from the trailing edge 48 to the leading edge 46.

After passing through the pressure side serpentine cooling channel 24, the cooling fluids pass through the aperture 60 and into the suction side serpentine cooling channel 28. The cooling fluids flow through the suction side serpentine channel 28 generally chordwise from near the leading edge 46 to the trailing edge 48. The cooling fluids may be exhausted from the suction side serpentine channel 28 through trailing edge exhaust orifice 80 in the trailing edge 48. A portion of the cooling fluids maybe exhausted through an exhaust orifice 61.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

wherein the cooling system comprises at least one leading edge cooling channel positioned in close proximity to the leading edge of the generally elongated blade;

a bifurcated mid-chord cooling chamber positioned between the at least one leading edge cooling channel and the trailing edge, wherein the mid-chord cooling chamber includes a pressure side serpentine cooling channel in contact with a pressure sidewall of the generally elongated blade and a suction side serpentine cooling channel in contact with a suction sidewall of the generally elongated blade and separated from the at least one pressure side serpentine cooling channel by a mid-chord rib;

an aperture in the mid-chord rib providing a cooling fluid passageway between the pressure and suction side serpentine cooling channels;

wherein the aperture is positioned in the mid-chord rib to exhaust cooling fluids from the pressure side serpentine cooling channel and to supply cooling fluids to the suction side serpentine cooling channel;

wherein the suction side serpentine cooling channel is positioned relative to the pressure side serpentine cooling channel such that a cooling fluid flow direction through the suction side serpentine cooling channel is generally opposite to the cooling fluid flow in adjacent portions of the pressure side serpentine cooling channel, thereby forming cooling fluid counterflow between the pressure side and suction side serpentine cooling channels;

wherein a first channel of the pressure side serpentine cooling channel includes an inlet for receiving cooling fluids;

wherein a second channel of the pressure side serpentine cooling channel is positioned between the first channel and the leading edge of the generally elongated blade, thereby creating a cooling fluid flow in the pressure side serpentine cooling channel flowing in a direction from the trailing edge to the leading edge; and a leading edge supply chamber, wherein the leading edge supply chamber and the pressure side serpentine cooling channel are separated by a rib, thereby preventing cooling fluid movement between the leading edge supply chamber and the pressure side serpentine cooling channel, and wherein the leading edge supply chamber and the suction side serpentine cooling channel are separated by the rib, thereby preventing cooling fluid movement between the leading edge supply chamber and the suction side serpentine cooling channel.

2. The turbine blade of claim 1, wherein the aperture in the mid-chord rib is positioned proximate to an end of the pressure side serpentine cooling channel and a beginning of the suction side serpentine cooling channel of the turbine blade.

3. The turbine blade of claim 1, wherein the pressure side serpentine cooling channel in contact with the pressure sidewall of the generally elongated blade is a triple pass serpentine cooling channel.

4. The turbine blade of claim 1, wherein the suction side serpentine cooling channel in contact with the suction sidewall of the generally elongated blade is a quadruple pass serpentine cooling channel.

5. The turbine blade of claim 4, wherein a fourth channel of the suction side serpentine cooling channel, which is downstream from upstream first, second and third channels, extends from the pressure sidewall to the suction sidewall.

6. The turbine blade of claim 1, wherein the rib defines the pressure and suction side serpentine cooling channels, and wherein the leading edge supply chamber extends spanwise and is positioned between the leading edge cooling channel and the rib.

7. The turbine blade of claim 6, further comprising at least one impingement orifice in a rib separating the leading edge supply chamber from the leading edge cooling channel.

8. The turbine blade of claim 1, further comprising at least one film cooling orifice positioned in an outer wall forming the leading edge.

9. The turbine blade of claim 8, wherein the at least one film cooling orifice comprises a plurality of film cooling holes forming a showerhead.

10. The turbine blade of claim 1, further comprising at least one trailing edge exhaust orifice extending from the suction side serpentine cooling channel to the trailing edge to exhaust cooling fluids through the trailing edge.

11. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

wherein the cooling system comprises at least one leading edge cooling channel positioned in close proximity to the leading edge of the generally elongated blade;

a bifurcated mid-chord cooling chamber positioned between the at least one leading edge cooling channel and the trailing edge, wherein the mid-chord cooling chamber includes a pressure side serpentine cooling channel in contact with a pressure sidewall of the generally elongated blade and a suction side serpentine cooling channel in contact with a suction sidewall of the generally elongated blade and separated from the at least one pressure side serpentine cooling channel by a mid-chord rib;

an aperture in the mid-chord rib providing a cooling fluid passageway between the pressure and suction side serpentine cooling channels;

wherein the aperture is positioned in the mid-chord rib to exhaust cooling fluids from the pressure side serpentine cooling channel and to supply cooling fluids to the suction side serpentine cooling channel;

wherein the suction side serpentine cooling channel is positioned relative to the pressure side serpentine cooling channel such that a cooling fluid flow direction through the suction side serpentine cooling channel is generally opposite to the cooling fluid flow in adjacent portions of the pressure side serpentine cooling channel, thereby forming cooling fluid counterflow between the pressure side and suction side serpentine cooling channels;

a leading edge supply chamber extending spanwise and positioned between the leading edge cooling channel and a rib defining the pressure and suction side serpentine cooling channels;

wherein a first channel of the pressure side serpentine cooling channel includes an inlet for receiving cooling fluids that is in communication with a fluid supply chamber;

wherein second and third channels of the pressure side serpentine cooling channel are positioned between the first channel and the leading edge of the generally elongated blade, thereby creating a cooling fluid flow in the pressure side serpentine cooling channel flowing in a direction from the trailing edge to the leading edge;

wherein the leading edge supply chamber and the pressure side serpentine cooling channel are separated by the rib, thereby preventing cooling fluid movement between the leading edge supply chamber and the pressure side serpentine cooling channel; and wherein the leading edge supply chamber and the suction side serpentine cooling channel are separated by the rib, thereby preventing cooling fluid movement between the leading edge supply chamber and the suction side serpentine cooling channel.

12. The turbine blade of claim 11, wherein the aperture in the mid-chord rib is positioned proximate to an end of the pressure side serpentine cooling channel and a beginning of the suction side serpentine cooling channel of the turbine blade.

13. The turbine blade of claim 11, wherein the pressure side serpentine cooling channel in contact with the pressure sidewall of the generally elongated blade is a triple pass serpentine cooling channel.

14. The turbine blade of claim 11, wherein the suction side serpentine cooling channel in contact with the suction sidewall of the generally elongated blade is a quadruple pass serpentine cooling channel.

15. The turbine blade of claim 14, wherein a fourth channel of the suction side serpentine cooling channel, which is downstream from upstream first, second and third channels, extends from the pressure sidewall to the suction sidewall.

16. The turbine blade of claim 11, further comprising at least one impingement orifice in a rib separating the leading edge supply chamber from the leading edge cooling channel.

17. The turbine blade of claim 11, further comprising at least one film cooling orifice positioned in an outer wall forming the leading edge forming a showerhead.

18. The turbine blade of claim 11, further comprising at least one trailing edge exhaust orifice extending from the suction side serpentine cooling channel to the trailing edge to exhaust cooling fluids through the trailing edge.

19. A turbine blade, comprising:

a generally elongated blade having a leading edge, a trailing edge, a tip section at a first end, a root coupled to the blade at an end generally opposite the first end for supporting the blade and for coupling the blade to a disc, and at least one cavity forming a cooling system in the blade;

wherein the cooling system comprises at least one leading edge cooling channel positioned in close proximity to the leading edge of the generally elongated blade;

a bifurcated mid-chord cooling chamber positioned between the at least one leading edge cooling channel and the trailing edge, wherein the mid-chord cooling chamber includes a pressure side serpentine cooling channel in contact with a pressure sidewall of the generally elongated blade and a suction side serpentine cooling channel in contact with a suction sidewall of the generally elongated blade and separated from the at least one pressure side serpentine cooling channel by a mid-chord rib;

an aperture in the mid-chord rib providing a cooling fluid passageway between the pressure and suction side serpentine cooling channels;

wherein the aperture is positioned in the mid-chord rib to exhaust cooling fluids from the pressure side serpentine cooling channel and to supply cooling fluids to the suction side serpentine cooling channel;

wherein the suction side serpentine cooling channel is positioned relative to the pressure side serpentine cooling channel such that a cooling fluid flow direction through the suction side serpentine cooling channel is generally opposite to the cooling fluid flow in adjacent portions of the pressure side serpentine cooling channel, thereby forming cooling fluid counterflow between the pressure side and suction side serpentine cooling channels;

a leading edge supply chamber extending spanwise and positioned between the leading edge cooling channel and a rib defining the pressure and suction side serpentine cooling channels;

at least one trailing edge exhaust orifice extending from the suction side serpentine cooling channel to the trailing edge to exhaust cooling fluids through the trailing edge;

wherein a first channel of the pressure side serpentine cooling channel includes an inlet for receiving cooling fluids that is in communication with a fluid supply chamber;

wherein the pressure side serpentine cooling channel in contact with the pressure sidewall of the generally elongated blade is a triple pass serpentine cooling channel;

wherein the suction side serpentine cooling channel in contact with the suction sidewall of the generally elongated blade is a quadruple pass serpentine cooling channel;

wherein second and third channels of the pressure side serpentine cooling channel are positioned between the first channel and the leading edge of the generally elongated blade, thereby creating a cooling fluid flow in the pressure side serpentine cooling channel flowing in a direction from the trailing edge to the leading edge;

wherein the leading edge supply chamber and the pressure side serpentine cooling channel are separated by the rib, thereby preventing cooling fluid movement between the leading edge supply chamber and the pressure side serpentine cooling channel; and wherein the leading edge supply chamber and the suction side serpentine cooling channel are separated by the rib, thereby preventing cooling fluid movement between the leading edge supply chamber and the suction side serpentine cooling channel.

* * * * *